US009715212B2

(12) United States Patent
Tsuchiya

(10) Patent No.: US 9,715,212 B2
(45) Date of Patent: Jul. 25, 2017

(54) TONER CONTAINER AND IMAGE FORMING APPARATUS

(71) Applicant: KYOCERA Document Solutions Inc., Osaka (JP)

(72) Inventor: Hiroaki Tsuchiya, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 15/219,673

(22) Filed: Jul. 26, 2016

(65) Prior Publication Data

US 2017/0031316 A1 Feb. 2, 2017

(30) Foreign Application Priority Data

Jul. 31, 2015 (JP) ..... 2015-152488

(51) Int. Cl.
*G03G 21/20* (2006.01)
*G03G 15/08* (2006.01)
*G03G 21/16* (2006.01)

(52) U.S. Cl.
CPC ..... *G03G 21/206* (2013.01); *G03G 15/0822* (2013.01); *G03G 21/1676* (2013.01); *G03G 2215/0132* (2013.01)

(58) Field of Classification Search
CPC combination set(s) only.
See application file for complete search history.

(56) References Cited

U.S. PATENT DOCUMENTS 6,188,421 B1 * 2/2001 Hayashi ..... G03G 15/0884 347/155
2014/0140719 A1 * 5/2014 Suzuki ..... G03G 15/0189 399/92
2014/0212164 A1 * 7/2014 Miyagawa ..... G03G 21/206 399/92

FOREIGN PATENT DOCUMENTS

JP H06-082234 B2 10/1994
JP 2509229 B2 4/1996
JP 2013-114134 6/2013

* cited by examiner

*Primary Examiner* — Minh Phan
(74) *Attorney, Agent, or Firm* — IP Business Solutions, LLC

(57) ABSTRACT

A toner container includes a body housing, the body housing being provided with a toner containing portion, an air flowing portion, an air inlet, and an air outlet. The toner containing portion is configured to contain toner for use in image formation. The air flowing portion adjoins the toner containing portion. The air inlet is configured so that air is taken into the air flowing portion therethrough. The air outlet is configured so that the air is discharged from the air flowing portion therethrough. The toner containing portion is separated from the air flowing portion by a partition wall and the toner container is configured to bring the air flowing through the air flowing portion comes into contact with the partition wall.

8 Claims, 15 Drawing Sheets

TONER CONTAINER AND IMAGE FORMING APPARATUS

INCORPORATION BY REFERENCE

This application claims priority to Japanese Patent Application No. 2015-152488 filed on Jul. 31, 2015, the entire contents of which are incorporated by reference herein.

BACKGROUND

The present disclosure relates to toner containers containing toner for use in image formation and image forming apparatuses with the same and particularly relates to a technique for cooling toner in a toner container.

With increasing range of functions and downsizing of image forming apparatuses, a large number of parts have been disposed in narrower and narrower spaces. Therefore, efficient cooling of the apparatus interior is being required.

Various cooling techniques effectively using narrow spaces are proposed, for example, to form an air passage between a process cartridge and a member of an apparatus body of the image forming apparatus or to use the interior of an optical system in the apparatus body of the image forming apparatus as an air passage.

Also, as for toner for use in image formation, it is necessary to take its cooling into consideration because the toner has a low melting temperature.

For example, there is a technique in which immediately before a recording paper sheet having a toner image formed thereon is discharged to a sheet output tray, air is sprayed on the recording paper sheet to cool the recording paper sheet and the toner image. Thus, the toner on the recording paper sheet to be discharged to the sheet output tray can be promptly set to prevent the occurrence of the trouble that a plurality of recording paper sheets discharged on the sheet output tray are bonded together by an adhesive action of unset toner. Furthermore, since the temperature of the recording paper sheet is lowered, the sheet output tray is prevented from being warmed. This has the effect of preventing temperature rise around a toner container in respect of a structure in which the toner container is disposed under a portion of an apparatus body housing where the sheet output tray is provided.

Meanwhile, a technique is proposed in which toner contained in a toner cartridge is encapsulated with a thin sheet, the toner cartridge is set in a toner supply device in an apparatus body of an image forming apparatus, and upon take-off of the sheet the toner is supplied from the toner cartridge to the toner supply device. This proposition includes no technical description on the cooling of the toner cartridge or the toner and the sheet does not serve to cool the toner. Also in this case, however, it is necessary to take the cooling of the toner into consideration.

SUMMARY

A technique improved over the aforementioned techniques is proposed as one aspect of the present disclosure.

A toner container according to an aspect of the present disclosure includes a body housing, the body housing being provided with a toner containing portion, an air flowing portion, an air inlet, and an air outlet.

The toner containing portion is configured to contain toner for use in image formation.

The air flowing portion adjoins the toner containing portion.

The air inlet is configured so that air is taken into the air flowing portion therethrough.

The air outlet is configured so that the air is discharged from the air flowing portion therethrough.

The toner containing portion is separated from the air flowing portion by a partition wall and the toner container is configured to bring the air flowing through the air flowing portion into contact with the partition wall.

An image forming apparatus according to another aspect of the present disclosure includes a toner container and is configured to form a toner image on a recording paper sheet.

The toner container includes a body housing.

The body housing is provided with a toner containing portion configured to contain toner for use in image formation.

An opening provided in the toner containing portion is closed by a partition wall, thus encapsulating the toner in the toner containing portion.

An apparatus body of the image forming apparatus is provided with an air flowing portion through which air flows, an air inlet through which the air is taken into the air flowing portion, an air outlet through which the air is discharged from the air flowing portion, a duct connected to the air inlet for the air flowing portion, and a fan configured to feed the air into the duct.

The toner container is removably attachable to the apparatus body and is configured so that, upon attachment of the toner container to the apparatus body, the toner containing portion of the toner container and the air flowing portion fit together with the partition wall in between.

DETAILED DESCRIPTION

A description will be given below of an embodiment of the present disclosure with reference to the drawings.

Figure 1:
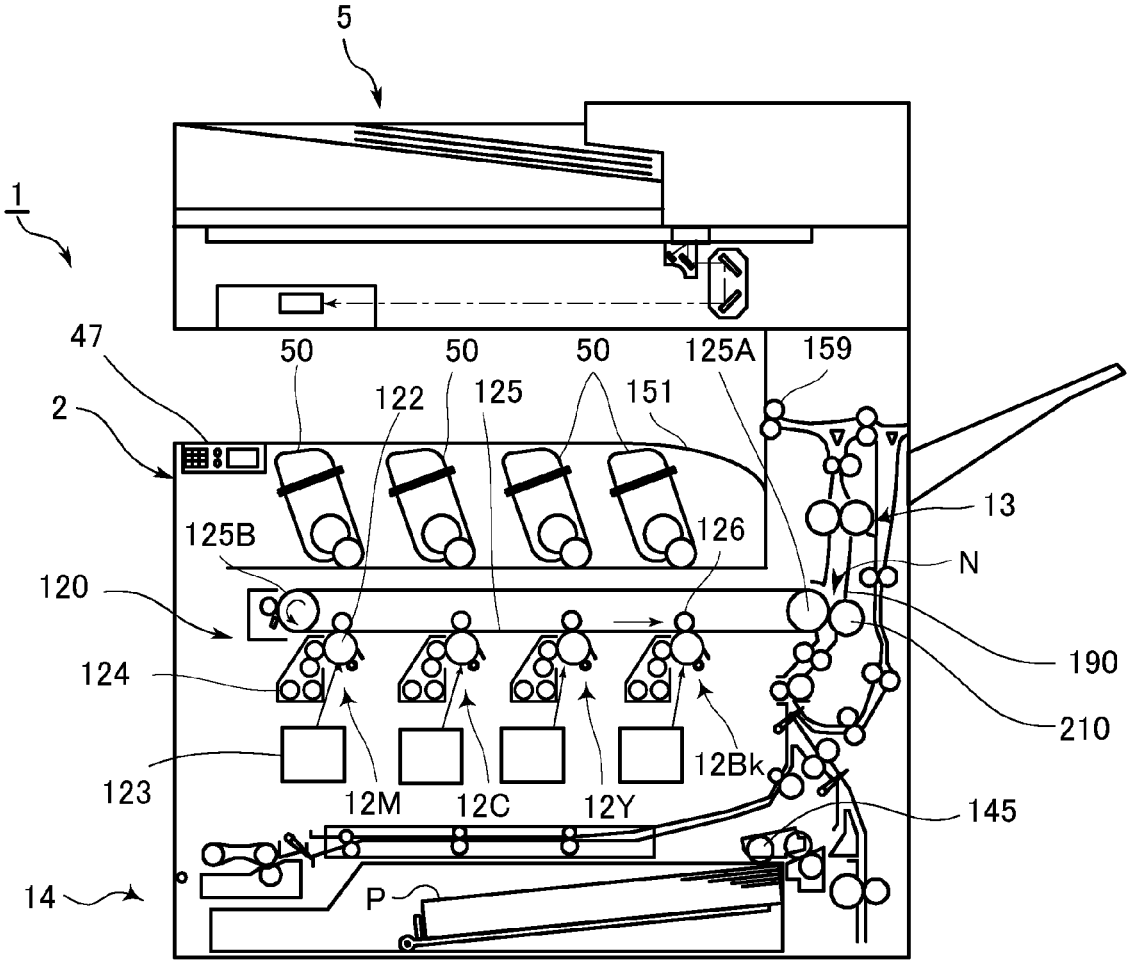
FIG. 1 is a front cross-sectional view showing the structure of an image forming apparatus to which a toner container according to one embodiment of the present disclosure is applied.
Figure 2:
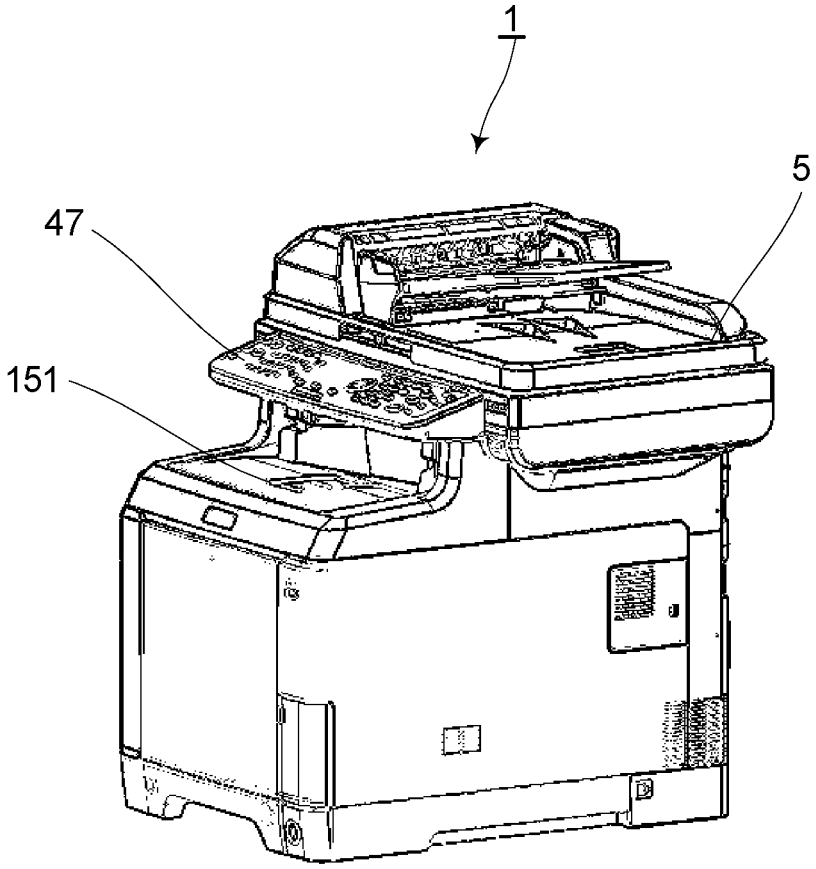
FIG. 2 is a perspective view showing the appearance of the image forming apparatus.
Figure 3:
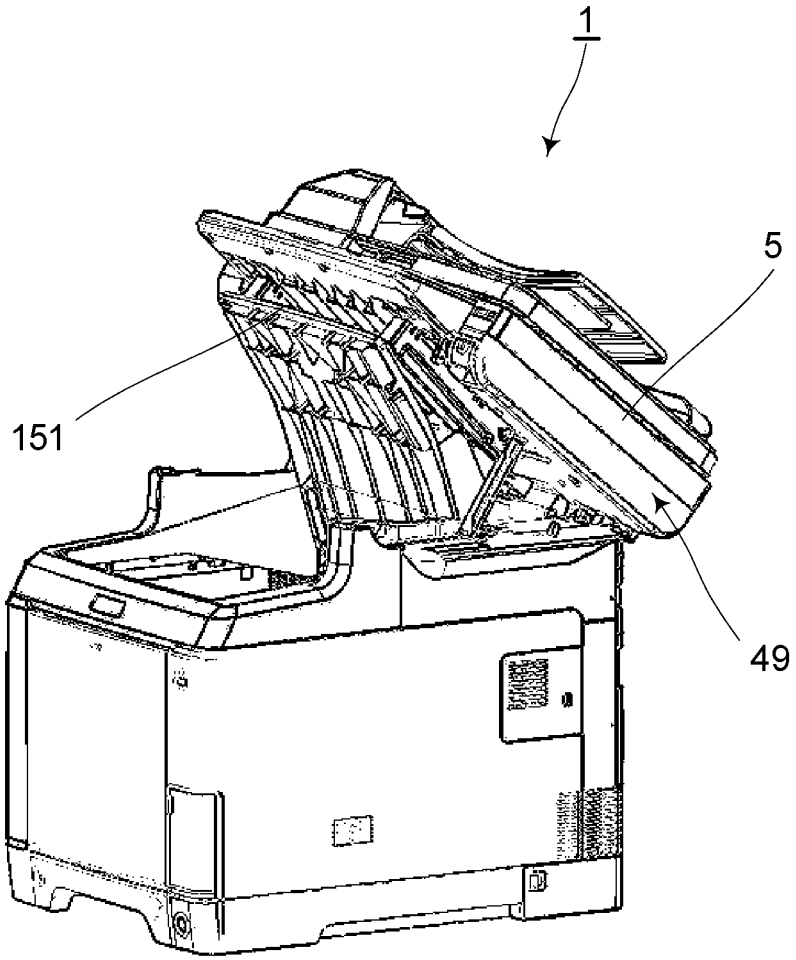
FIG. 3 is a perspective view showing a state where an upper portion of the image forming apparatus is opened.

FIG. 1 is a front cross-sectional view showing the structure of an image forming apparatus to which a toner container according to one embodiment of the present disclosure is applied. FIG. 2 is a perspective view showing the appearance of the image forming apparatus and FIG. 3 is a perspective view showing a state where an upper portion of the image forming apparatus is opened.

The image forming apparatus 1 is a multifunction peripheral having multiple functions including, for example, a copy function, a print function, a scan function, and a facsimile function. The image forming apparatus 1 is made up so that an apparatus body 2 is provided with an image scanner unit (ISU) 5, an operating section 47, an image forming section 120, a fixing device 13, a sheet feed section 14, a toner container 50 according to this embodiment, and so on.

The operating section 47 is configured to accept user's instructions for various types of operations and processing executable on the image forming apparatus 1, such as an instruction to perform an image forming operation and an instruction to perform an image scanning operation.

In performing the image scanning operation, the ISU 5 optically scans an image of an original document and generates image data from the scanned image. The image data generated by the ISU 5 is stored on an internal HDD, a network-connected computer or the like.

In performing the image forming operation, the image forming section 120 forms a toner image on a recording paper sheet P serving as a recording medium fed from the sheet feed section 14, based on image data generated by the above image scanning operation, image data received from the network-connected computer or a user terminal device, such as a smartphone, image data stored on the internal HDD, or other image data.

Each of image forming units 12M, 12C, 12Y, and 12Bk of the image forming section 120 includes a photosensitive drum 122, a charging device operable to uniformly charge the surface of the photosensitive drum 122, a laser scanning unit (LSU) 123 operable to expose the surface of the photosensitive drum 122 to laser light to form an electrostatic latent image on the surface thereof, a developing device 124 operable to develop the electrostatic latent image on the surface of the photosensitive drum 122 into a toner image using toner, and a primary transfer roller 126.

In performing color printing, the image forming unit 12M for magenta, the image forming unit 12C for cyan, the image forming unit 12Y for yellow, and the image forming unit 12Bk for black in the image forming section 120 uniformly charge the surfaces of their respective photosensitive drums 122, then expose them to laser light to form respective electrostatic latent images corresponding to images of their color components on the surfaces, develop the electrostatic latent images on the surfaces of the photosensitive drums 122 with the developing device 124 to form respective toner images of their color components on the photosensitive drums 122, and then allow their respective primary transfer rollers 126 to primarily transfer the toner images to an intermediate transfer belt 125 mounted around a drive roller 125A and a driven roller 125B.

The intermediate transfer belt 125 has an outside surface serving as an image carrying surface on which toner images are to be transferred and is configured to be driven in engagement against the peripheral surfaces of the photosensitive drums 122 by the drive roller 125A.The intermediate transfer belt 125 is configured to travel in an endless path between the drive roller 125A and the driven roller 125B while synchronizing with each photosensitive drum 122.

The toner images of different color components transferred to the intermediate transfer belt 125 are superposed each other on the intermediate transfer belt 125 by controlling their transfer timings, resulting in a multicolor toner image. A secondary transfer roller 210 is configured to secondarily transfer the multicolor toner image formed on the surface of the intermediate transfer belt 125, at a nip between the secondary transfer roller 210 and the intermediate transfer belt 125, to a recording paper sheet P conveyed from the sheet feed section 14 along a conveyance path 190.

Thereafter, the fixing device 13 applies heat and pressure to the recording paper sheet P, thus fixing the toner image on the recording paper sheet P by heat and pressure. Then, the recording paper sheet P is discharged through an output roller pair 159 to a sheet output tray 151.

The sheet feed section 14 is configured to contain a plurality of recording paper sheets P and allows a pick-up roller 145 to be rotationally driven and thus convey a recording paper sheet P to the conveyance path 190.

Meanwhile, four toner containers 50 according to this embodiment are provided above the image forming section 120. The toner containers 50 contain different colored toners, i.e., a magenta toner, a cyan toner, a yellow toner, and a black toner, and are configured to supply these toners via their respective paths (not shown) to the respective developing devices 124 of the image forming units 12M, 12C, 12Y, and 12Bk.

Furthermore, as shown in FIGS. 2 and 3, the image forming apparatus 1 includes a cover unit 49 into which the ISU 5, the sheet output tray 151, and so on are integrated. The cover unit 49 is supported to a lower portion of the apparatus body 2 so as to be freely opened and closed. Each toner container 50 can be exchanged for another one with the cover unit 49 open.

Figure 4:
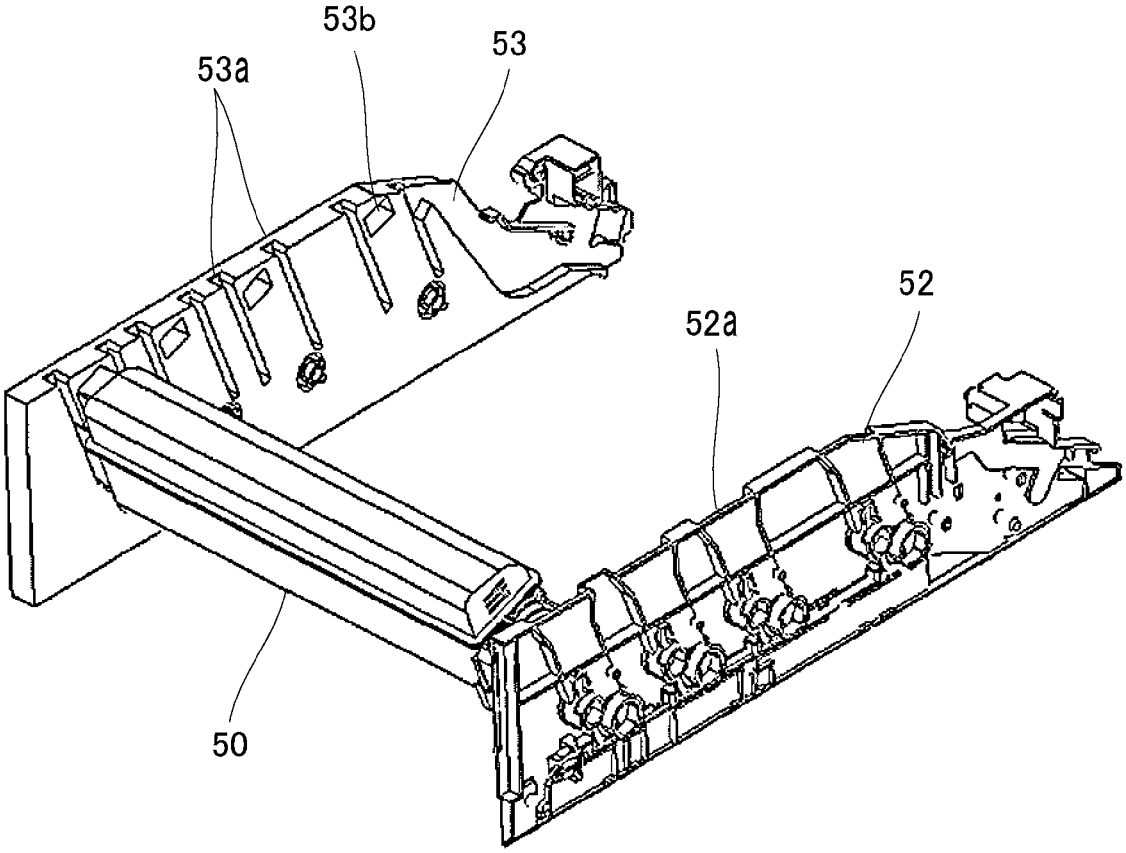
FIG. 4 is a perspective view showing a state of attachment of the toner container in the interior of the image forming apparatus.
Figure 5:
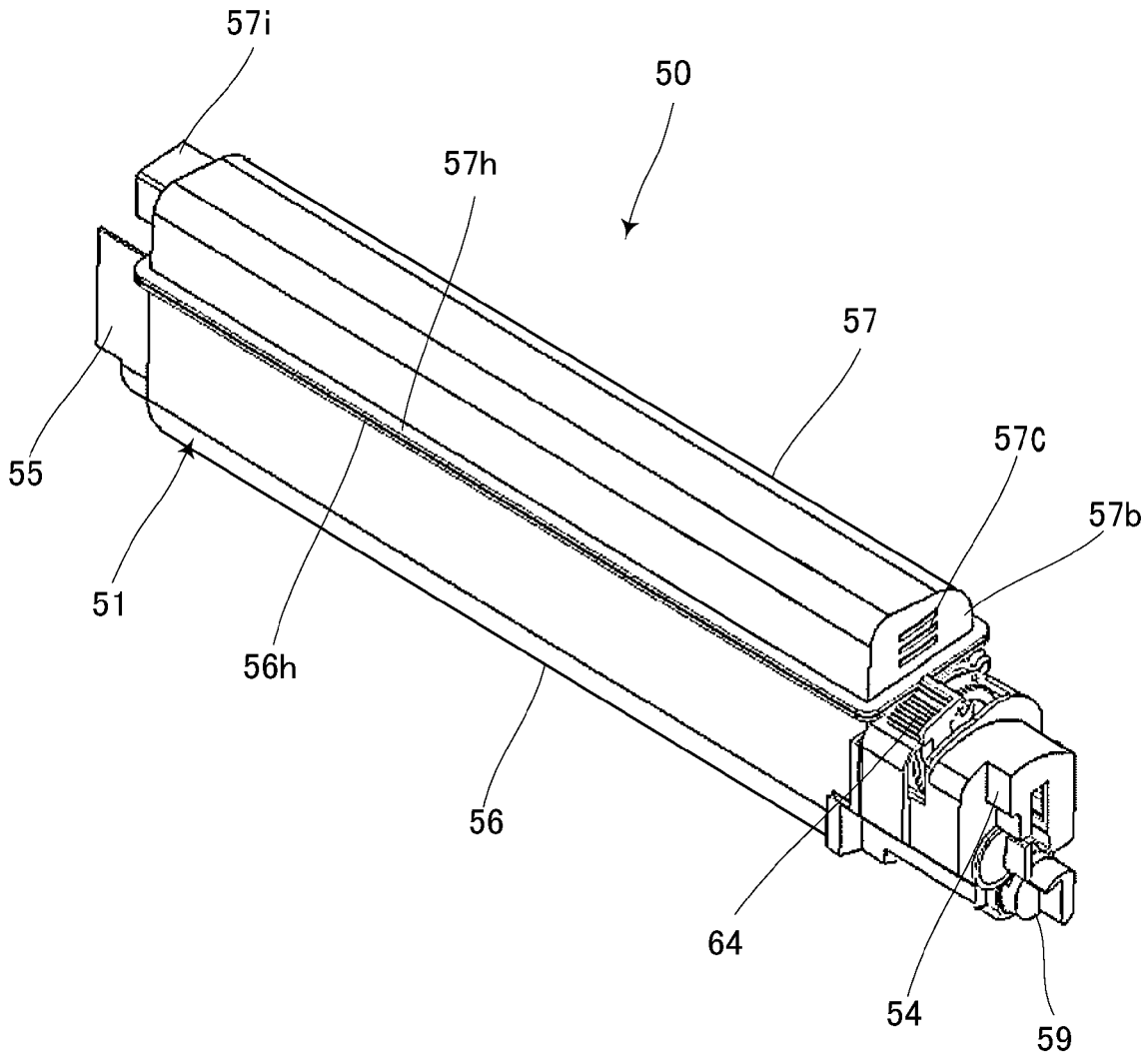
FIG. 5 is a perspective view showing the toner container as viewed from the front side.

Next, a detailed description will be given of the toner container 50 according to this embodiment. FIG. 4 is a perspective view showing a state of attachment of the toner container 50 in the interior of the image forming apparatus 1. FIG. 5 is a perspective view showing the toner container 50 as viewed from the front side and FIG. 6 is a perspective view showing the toner container 50 as viewed from the back side.

Figure 6:
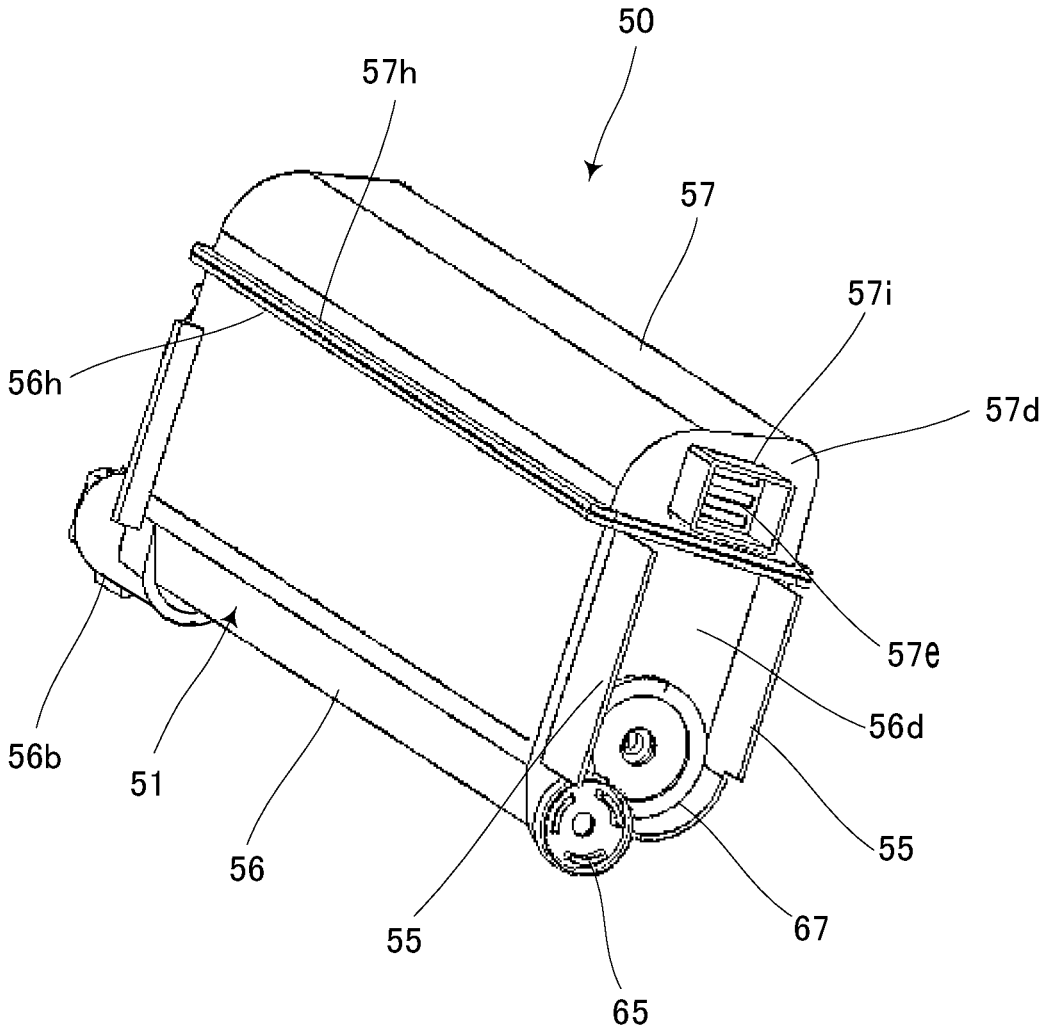
FIG. 6 is a perspective view showing the toner container as viewed from the back side.

As shown in FIGS. 4 to 6, the toner container 50 is supported by a pair of support frames 52, 53 provided in the interior of the apparatus body 2 of the image forming apparatus 1. One end of the toner container 50 located on the front side is provided with a cover 54 and the other end thereof located on the back side is provided with two guide extensions 55. Furthermore, the inside wall surface of the support frame 52 located on the front side has guide recesses 52*a*, one for each toner container 50, while the inside wall surface of the support frame 53 on the back side has guide grooves 53*a*, two for each toner container 50. When the cover 54 of the toner container 50 is fitted into the associated guide recess 52*a* of the support frame 52 and the two guide extensions 55 of the toner container 50 are fitted into the associated two guide grooves 53*a* of the support frame 53, the toner container 50 is connected and supported between the pair of support frames 52, 53.

To support the four toner containers 50, four guide recesses 52*a* are formed in the support frame 52 and four pairs of guide grooves 53*a* are formed in the support frame 53.

Figure 7:
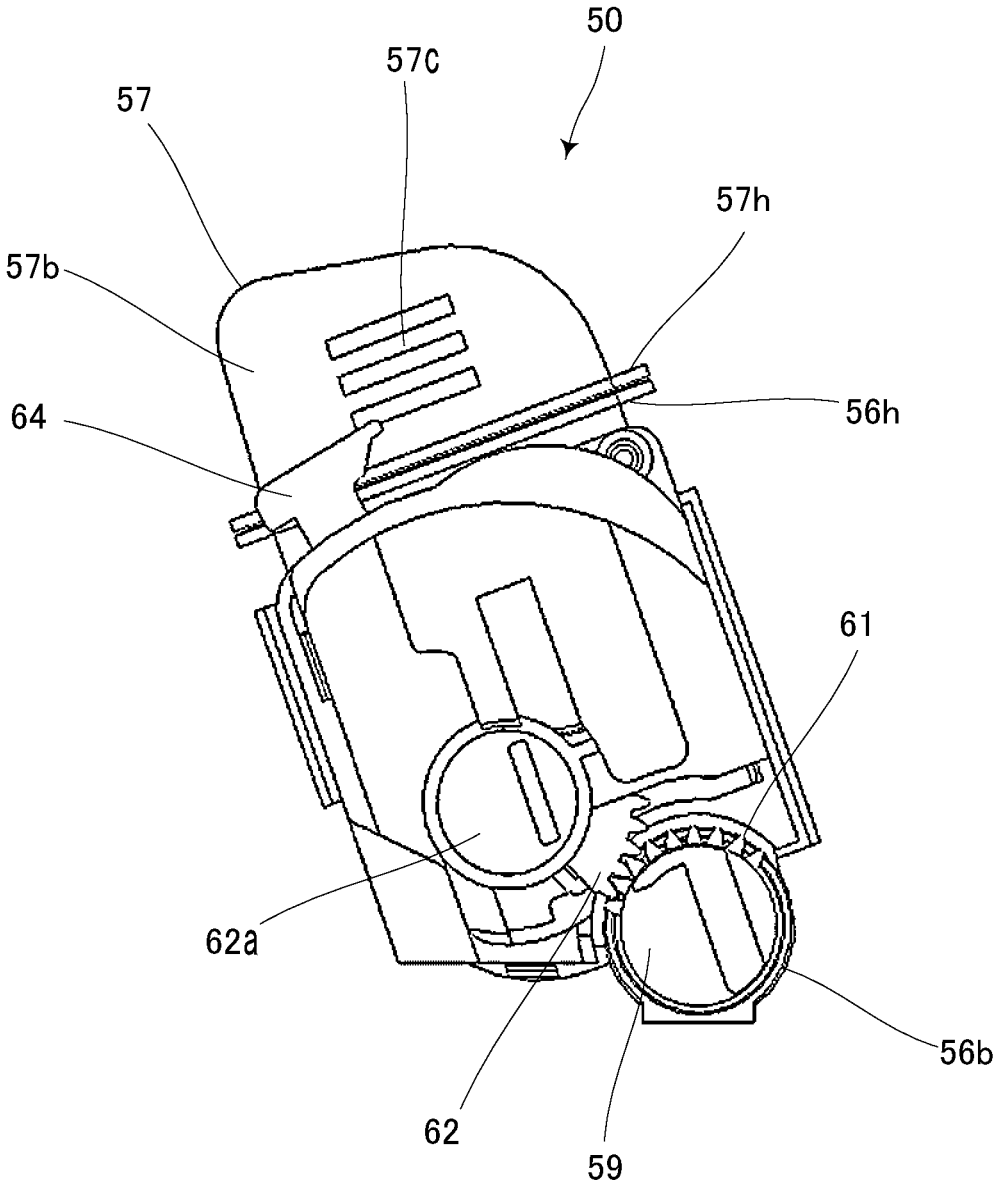
FIG. 7 is a front view showing one end of the toner container located on the front side thereof.
Figure 8:
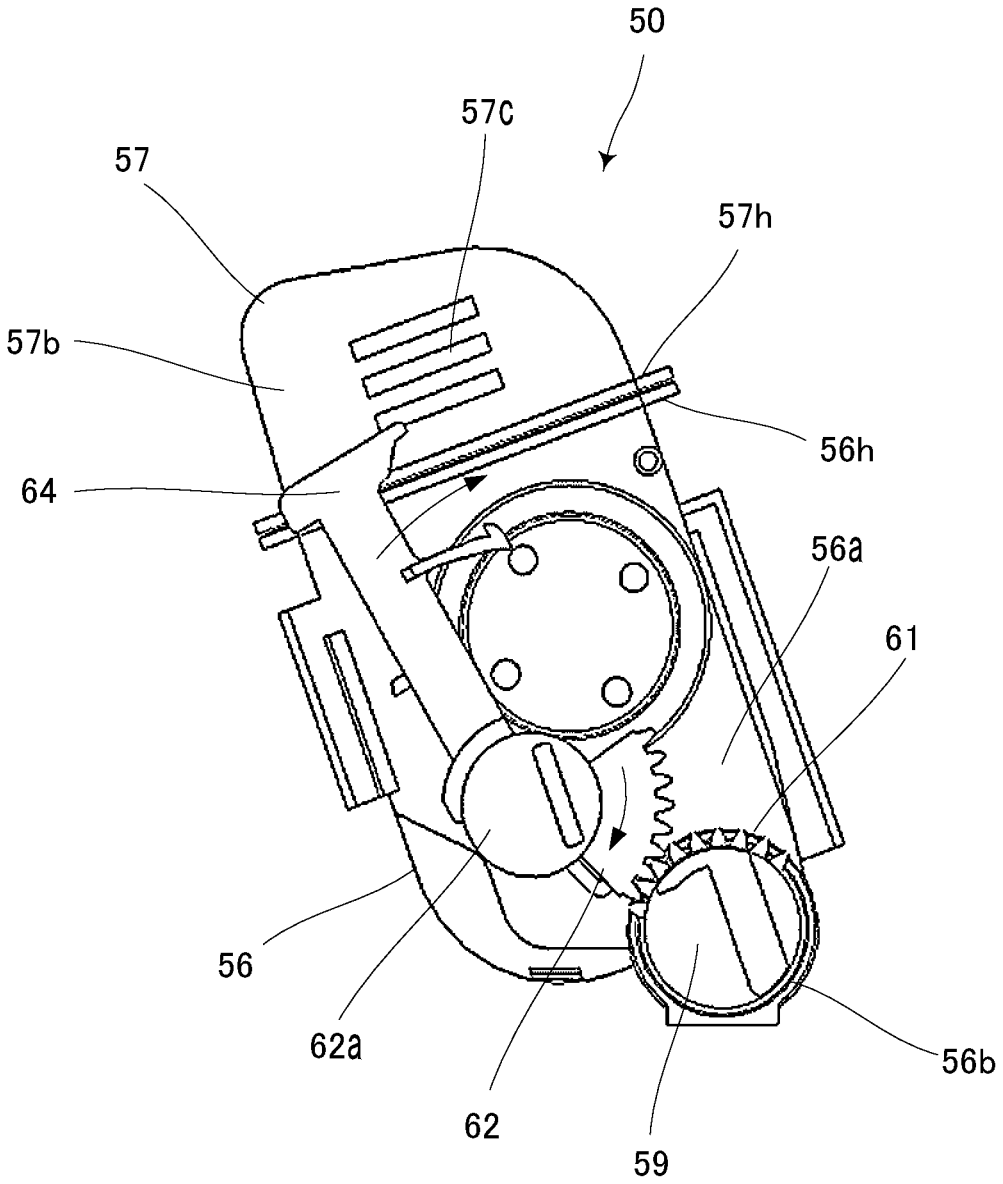
FIG. 8 is a front view showing a state where a cover located at the one end of the toner container is removed.
Figure 9:
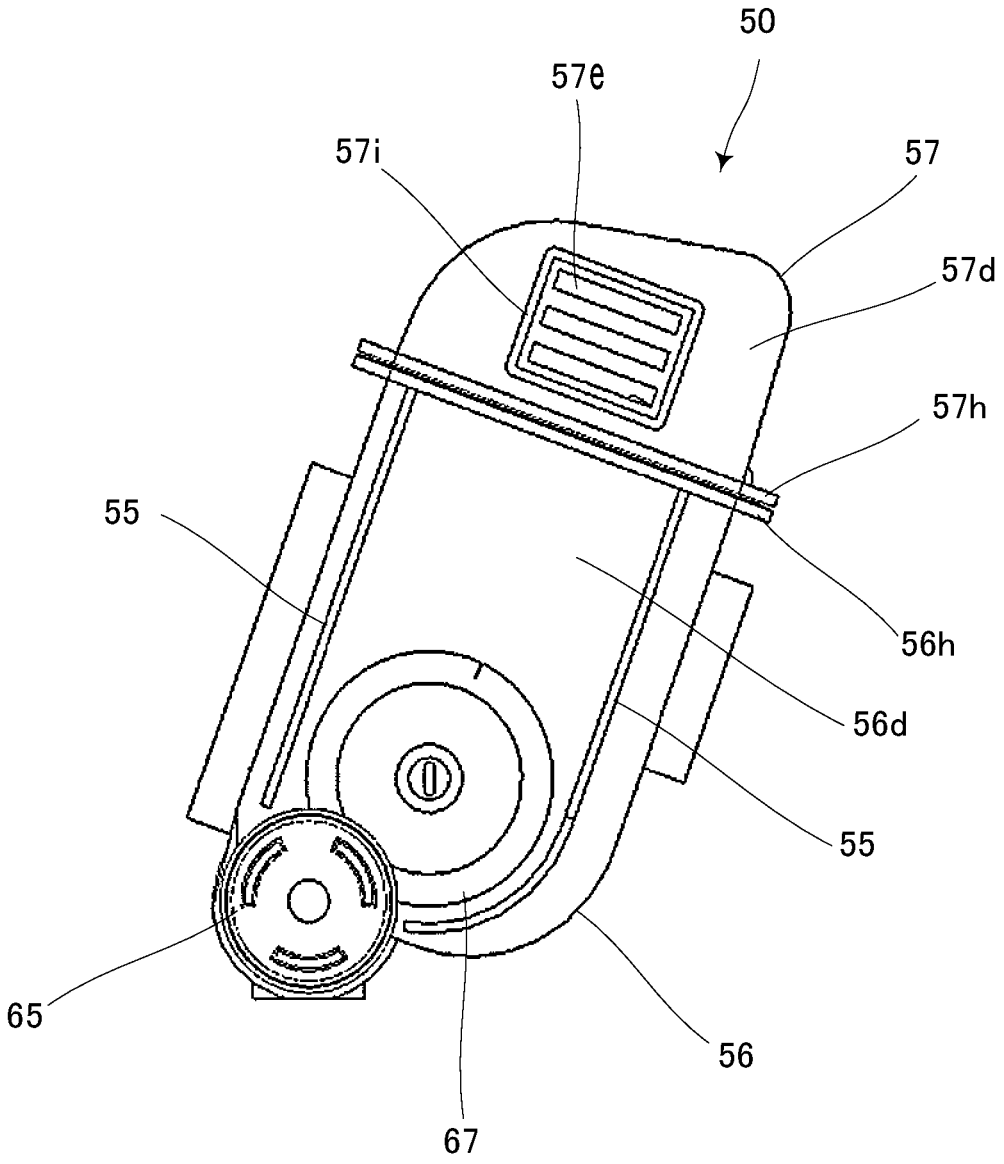
FIG. 9 is a back view showing the other end of the toner container located on the back side thereof.
Figure 10A:
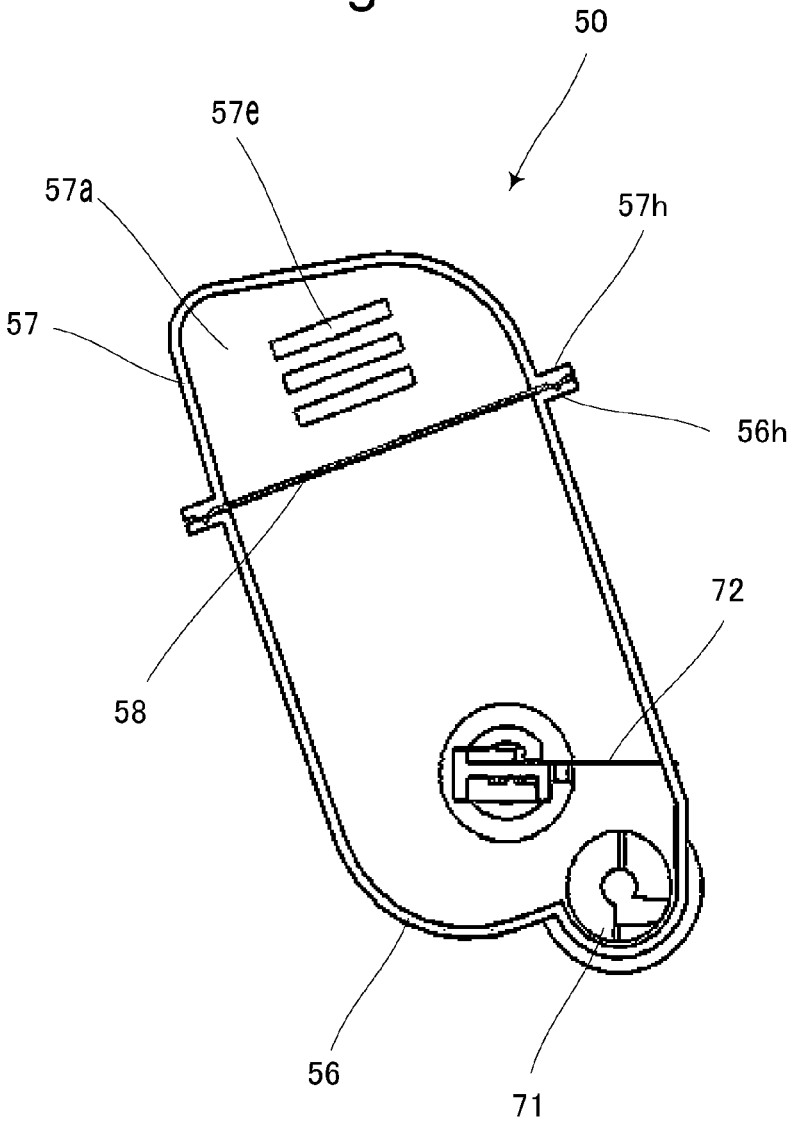
FIG. 10A is a transverse cross-sectional view showing the toner container.
Figure 10B:
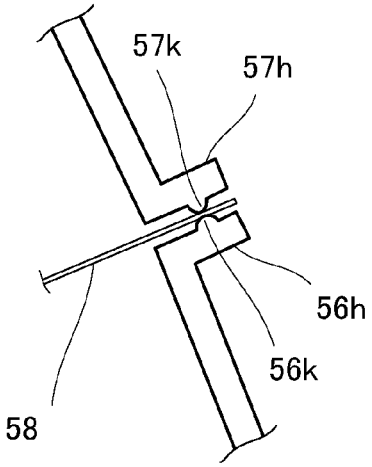
FIG. 10B is an enlarged transverse cross-sectional view of a portion of the toner container.
Figure 11:
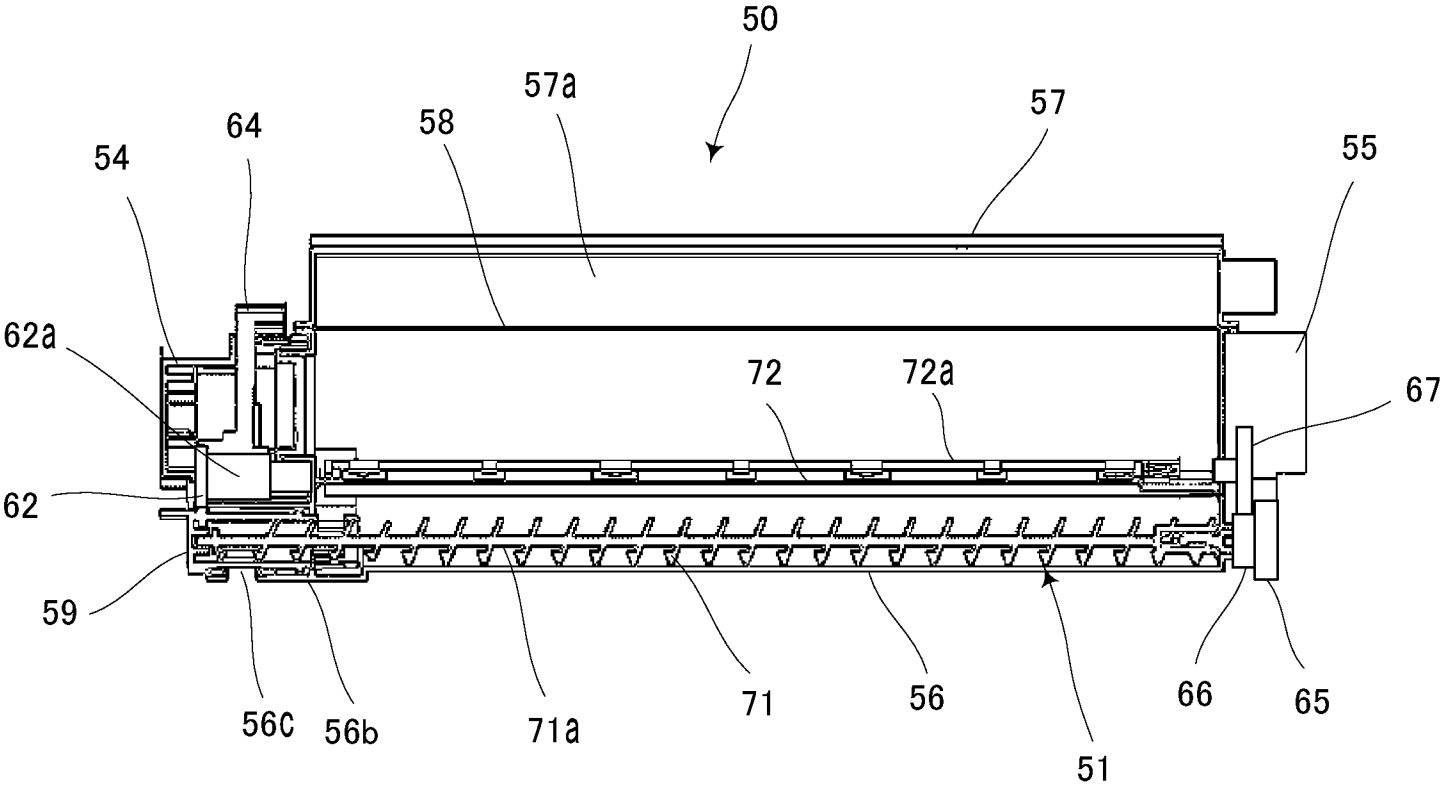
FIG. 11 is a longitudinal cross-sectional view showing the toner container.

FIG. 7 is a front view showing the one end of the toner container 50 located on the front side thereof and FIG. 8 is a front view showing a state where the cover 54 located at the one end of the toner container 50 is removed. FIG. 9 is a back view showing the other end of the toner container 50 located on the back side thereof. FIG. 10A is a transverse cross-sectional view showing the toner container 50 and FIG. 10B is an enlarged transverse cross-sectional view of a portion of the toner container 50. FIG. 11 is a longitudinal cross-sectional view showing the toner container 50.

As shown in FIGS. 7 to 11, a body housing 51 of the toner container 50 is formed of a toner containing portion 56 and an air flowing portion 57 and provided with a partition wall 58 separating the toner containing portion 56 from the air flowing portion 58. The toner containing portion 56 contains toner and the partition wall 58 is sandwiched between a flange 56*h* of an upper opening of the toner containing portion 56 and a flange 57*h* of a lower opening of the air flowing portion 57. The toner is encapsulated in the toner containing portion 56 by the partition wall 58. The material of the partition wall 58 is a thin sheet of synthetic resin or a film of synthetic resin.

For example, the partition wall 58 is sandwiched between the flange 56*h* of the toner containing portion 56 and the flange 57*h* of the air flowing portion 57 and then bonded to each of the flanges 56*h*, 57*h* by ultrasonic welding. In using the ultrasonic welding, it is necessary to generate a large amount of frictional heat between each flange 56*h*, 57*h* and the partition wall 58. Therefore, for example, as shown in FIG. 10B, ridges 56*k* and 57*k* are previously formed on the top surface of the flange 56*h* and the under surface of the flange 57*h* to form loops along the flanges 56*h* and 57*h*, respectively. The ridges 56*k*, 57*k* come into line contact with the partition wall 58 when the partition wall 58 is sandwiched between the flanges 56*h*, 57*h*. In this state, a large amount of frictional heat is generated between each of the ridges 56*k*, 57*k* on the flanges 56*h*, 57*h* and the partition wall 58 by ultrasonic waves to melt the ridges 56*k*, 57*k* on the flanges 56*h*, 57*h* by the frictional heat, thus bonding each flange 56*h*, 57*h* to the partition wall 58.

An air passage 57*a* is formed in the air flowing portion 57. An air outlet slit 57*c* is formed in a front side wall 57*b* of the air flowing portion 57, an air inlet slit 57*e* is formed in a back side wall 57*d* of the air flowing portion 57, and a frame casing 57*i* is formed on the back side wall 57*d* to surround the air inlet slit 57*e*. In the air flowing portion 57, air is taken through the air inlet slit 57*e* into the air passage 57*a*, flows through the air passage 57*a* while being in contact with the partition wall 58, and is then discharged through the air outlet slit 57*c* from the air passage 57*a*. The air flowing portion 57 also functions as a lid for protecting the thin partition wall 58.

In this description, the body housing 51 is an example of the body housing defined in What is claimed is, the toner containing portion 56 is an example of the toner containing portion defined in What is claimed is, the air flowing portion 57 is an example of the air flowing portion defined in What is claimed is, the air inlet slit 57*e* and the air outlet slit 57*c* are respective examples of the air inlet and air outlet defined in What is claimed is, and the partition wall 58 is an example of the partition wall defined in What is claimed is.

Referring next to FIGS. 7, 8, and 11, a cylindrical portion 56*b* is formed on the front side wall 56*a* of the toner containing portion 56 and a toner discharge port 56*c* is formed in a bottom portion of the peripheral wall of the cylindrical portion 56*b*. Furthermore, a cylindrical shutter 59 is rotatably inserted in the cylindrical portion 56*b* and an opening is formed in a portion of the peripheral wall of the cylindrical shutter 59. In FIG. 11, the opening of the cylindrical shutter 59 is not superposed on the toner discharge port 56*c* of the cylindrical portion 56*b*, so that the toner discharge port 56*c* is closed.

A rotating gear 61 is formed on the outer periphery of the cylindrical shutter 59 and meshed with a sector gear 62, a shaft 62*a* of the sector gear 62 is rotatably supported at the front side wall 56*a* of the toner containing portion 56, and a lever 64 is connected to the shaft 62*a* of the sector gear 62. When the lever 64 is manually turned in the direction of the arrow, the sector gear 62 also turns in the direction of the arrow and the rotating gear 61 and the cylindrical shutter 59 turn in the direction opposite to the direction of the arrow, so that the opening of the cylindrical shutter 59 is superposed on the toner discharge port 56*c* of the cylindrical portion 56*b*.

As shown in FIGS. 10A and 11, a conveying screw 71 is provided at the inside bottom of the toner containing portion 56 and an end portion of the conveying screw 71 is inserted in the cylindrical shutter59. Furthermore, a stirring member 72 is provided above the conveying screw 71.

As shown in FIGS. 9 and 11, a conveying gear 65, a small gear 66, and a stirring gear 67 are provided at the back side wall 56*d* of the toner containing portion 56. Both ends of a shaft 71*a* of the conveying screw 71 are rotatably supported by the inside wall of the cylindrical shutter 59 and the back side wall 56*d*. The conveying gear 65 and the small gear 66 are fixed to one end of the shaft 71*a*. On the other hand, both ends of a shaft 72*a* of the stirring member 72 are rotatably supported by the side walls 56*a* and 56*d* of the toner containing portion 56. The stirring gear 67 is fixed to one end of the shaft 72*a* and meshed with the small gear 66.

In a state where, as shown in FIG. 4, the toner container 50 is connected and supported between the pair of support frames 52 and 53, the conveying gear 65 is meshed with a drive gear (not shown) mounted on the image forming apparatus 1. When the drive gear is driven into rotation, the conveying gear 65 rotates to rotate the conveying screw 71. Furthermore, the rotation of the conveying gear 65 is transmitted through the small gear 66 to the stirring gear 67, so that the stirring gear 67 also rotates at a lower rotational speed than the conveying gear 65 to rotate the stirring member 72.

Thus, the toner in the toner containing portion 56 is conveyed to the cylindrical shutter 59 by the conveying screw 71, discharged through the opening of the cylindrical shutter 59 and the toner discharge port 56*c* of the cylindrical portion 56*b*, and then supplied along a path (not shown) in the image forming apparatus 1 to the developing device 124. Furthermore, the toner in the toner containing portion 56 is stirred by the stirring member 72, which prevents the toner from agglomerating.

If the temperature of toner contained in the toner container 50 becomes too high, the toner melts. For example, because a recording paper sheet P just after being heated by the fixing device 13 is discharged to the sheet output tray 151, the temperature of the sheet output tray 151 rises and radiation heat from the sheet output tray 151 is applied to the toner container 50, so that the toner in the toner container 50 may be increased in temperature and melted.

Therefore, the toner container 50 according to this embodiment has a distinctive structure capable of effectively cooling the toner in the toner container 50. Next, a detailed description will be given of this distinctive structure.

As seen from FIGS. 10A and 11, the toner containing portion 56 and the air flowing portion 57 are separated from each other by the partition wall 58 in the form of a thin sheet or a film. Furthermore, the air passage 57*a*, the air inlet slit 57*e*, and the air outlet slit 57*c* are formed in the air flowing portion 57, so that air is taken through the air inlet slit 57*e* into the air passage 57*a*, flows through the air passage 57*a* while being in contact with the partition wall 58, and is then discharged through the air outlet slit 57*c* from the air passage 57*a*.

Figure 12:
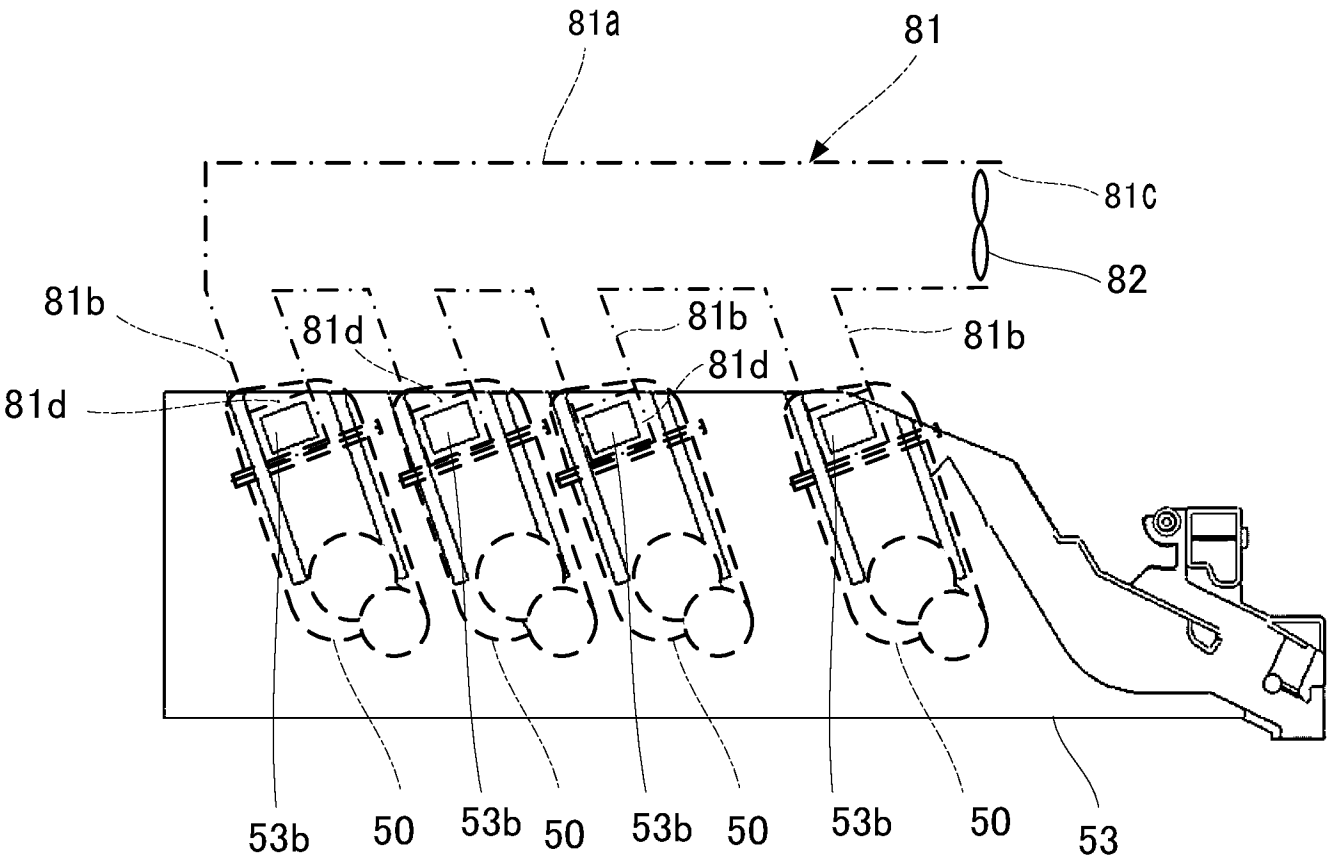
FIG. 12 is a side view schematically showing a duct and a fan through which air is blown into air inlet slits of air flowing portions.

FIG. 12 is a side view schematically showing a duct and a fan through which air is blown into the air inlet slits 57*e* of the air flowing portions 57. In FIG. 12, the duct 81 and the fan 82 are provided in the interior of the apparatus body 2 of the image forming apparatus 1. The duct 81 includes a main duct 81*a* and four sub ducts 81*b* branching from the main duct 81*a*. The fan 82 is disposed at an intake opening 81*c* of the main duct 81*a*. Furthermore, four connection openings 53*b* are formed in the back-side support frame 53 and connected one to each of respective outtake openings 81*d* of the four sub ducts 81*b*.

When the four toner containers 50 are connected and supported between the support frames 52 and 53, the frame casings 57*i* on the back surfaces of the air flowing portions 56 of the toner containers 50 are aligned and fitted one with each of the connection openings 53*b* of the back-side support frame 53. Thus, in all of the toner containers 50, the air inlet slits 57*e* inside the frame casings 57*i* of the air flowing portions 57 are individually connected through the connection openings 53*b* to the discharge openings 81*d* of the sub ducts 81*b*.

When in this state the fan 82 is actuated to take air through the intake opening 81*c* of the main duct 81*a* into the main duct 81*a*, the air is introduced through the sub ducts 81*b* to the air inlet slits 57*e* of the air flowing portions 57 of the toner containers 50, blown into the air passages 57*a* of the air flowing portions 57, flows through the air passages 57*a* while being in contact with the partition walls 58 of the toner containers 50, and is then discharged through the air outlet slits 57*c* of the air flowing portions 57.

During the course of flowing, in any of the toner containers 50, the air flowing through the air passage 57*a* of the air flowing portion 57 is in contact with the partition wall 58. As a result, the heat of the toner is transmitted to and taken by the flowing air and the toner is promptly cooled. Since the partition wall 58 is formed of a thin sheet of synthetic resin or a film of synthetic resin, the overall heat transfer coefficient from each toner containing portion 56 through the partition wall 58 to the air passage 57*a* is high, so that the toner contained in the toner containing portion 56 is heat exchanged through the partition wall 58 with the air flowing through the air passage 57*a*. Thus, the toner in the toner container 50 is effectively cooled by the air. Furthermore, since the air flows through the narrow air passage 57*a* of the air flowing portion 57, the toner in the toner container 50 can be cooled even if the amount of flowing air is small.

In the past, a large amount of air was introduced around a toner container 50. However, because the toner container 50 had a wall thickness of about 2 mm, the toner in the toner container 50 was difficult to cool.

Furthermore, although the partition wall 58 is formed of a thin sheet of synthetic resin or a film of synthetic resin, it is protected by the air flowing portion 57. Therefore, the partition wall 58 is prevented from being carelessly broken.

Next, a description will be given of the overall heat transfer coefficient from toner in the toner containing portion 56 through the partition wall 58 to the air passage 57*a*.

First, the amount of heat transport (W) through the partition wall 58 can be represented by the following formula (1) based on the heat conductivity (W/m° C.), the heat transfer cross-sectional area (sq. m. (square meter)), and the thickness (m) of the partition wall 58 and the temperature difference (° C.) between both surfaces of the partition wall 58.

$$\text{Amount of heat transport (W)}=(\text{heat conductivity (W/m° C.)})\times(\text{heat transfer cross-sectional area (sq. m.)})/(\text{thickness (m)})\times(\text{temperature difference (° C.)}) \quad (1)$$

Therefore, it can be seen that as the thickness (m) of the partition wall 58 decreases and the heat conductivity (W/m° C.) of the partition wall 58 increases, the amount of heat transport (W) becomes larger and the effect of cooling toner becomes higher.

In this relation, the effect of cooling toner will be considered below by taking, for comparison, 2 mm and 0.2 mm as the thickness of the partition wall 58 and synthetic resin of low heat conductivity and aluminum of high heat conductivity as the material of the partition wall 58.

The effect of cooling toner corresponds to the overall heat transfer coefficient (W/sq. m.° C.) from the toner containing portion 56 through the partition wall 58 to the air passage 57*a* and the overall heat transfer coefficient (W/sq. m.° C.) can be represented by the following formula (2).

$$\text{Overall heat transfer coefficient (W/sq. m.° C.)}=1/(\alpha+\beta+\gamma) \quad (2)$$

In the above formula, $\alpha$=1/(heat-transfer coefficient between air in the toner containing portion 56 and the inside wall surface of the partition wall 58), $\beta$=(thickness (m) of the partition wall 58)/(heat conductivity (W/m° C.) of the partition wall 58), and $\gamma$=1/(heat-transfer coefficient between the outside wall surface of the partition wall 58 and air in the air passage 57*a*).

Now suppose that air flows by natural convection. In this case, both of the heat-transfer coefficient between air in the toner containing portion 56 and the inside wall surface of the partition wall 58 and the heat-transfer coefficient between the outside wall surface of the partition wall 58 and air in the air passage 57*a* can be regarded to be about 10 (W/sq. m.° C.) and, thus, the above variables $\alpha$ and $\gamma$ can be determined.

Furthermore, assuming that the thickness of the partition wall 58 is 2 mm and the heat conductivity of synthetic resin making the partition wall 58 is about 0.3 (W/m° C.), the above variable $\beta$ can be determined. In the above manners, all the variables $\alpha$, $\beta$, and $\gamma$ can be determined and, thus, the overall heat transfer coefficient (W/sq. m.° C.) when a 2 mm-thick synthetic resin sheet is used as the partition wall 58 can be determined from the following formula (3).

$$\text{Overall heat transfer coefficient for synthetic resin}=1/((1/10)+(0.002/0.3)+(1/10))=4.84(\text{W/sq. m.° C.}) \quad (3)$$

Likewise, when $\beta$ is determined by assuming that the thickness of the partition wall 58 is 2 mm and the heat conductivity of aluminum making the partition wall 58 is about 120 (W/m° C.), the overall heat transfer coefficient (W/sq. m.° C.) when a 2 mm-thick aluminum sheet is used as the partition wall 58 can be determined from the following formula (4).

$$\text{Overall heat transfer coefficient for aluminum}=1/((1/10)+(0.002/120)+(1/10))=5.00(\text{W/sq. m.° C.}) \quad (4)$$

On the other hand, when the thickness of the partition wall 58 is 0.2 mm, the overall heat transfer coefficient (W/sq. m.° C.) when synthetic resin is used as the material of the partition wall 58 can be determined from the following formula (5) and the overall heat transfer coefficient (W/sq. m.° C.) when aluminum is used as the material of the partition wall 58 can be determined from the following formula (6).

$$\text{Overall heat transfer coefficient for synthetic resin}=1/((1/10)+(0.0002/0.3)+(1/10))=4.98(\text{W/sq. m.° C.}) \quad (5)$$

$$\text{Overall heat transfer coefficient for aluminum}=1/((1/10)+(0.0002/120)+(1/10))=5.00(\text{W/sq. m.° C.}) \quad (6)$$

As is obvious from comparison between the above formulae (3) and (4) and comparison between the above formulae (5) and (6), when aluminum is used as the material of the partition wall 58, the overall heat transfer coefficient (W/sq. m.° C.) from the toner containing portion 56 through the partition wall 58 to the air passage 57*a* becomes higher than when synthetic resin is used as the material of the partition wall 58. The reason for this is that the heat conductivity (120 W/m° C.) of aluminum is 400 times the heat conductivity (0.3 W/m° C.) of synthetic resin.

However, when the thickness of the partition wall 58 is small, the difference in overall heat transfer coefficient (W/sq. m.° C.) between the use of aluminum and the use of synthetic resin becomes small. More specifically, when the thickness of the partition wall 58 is 2.0 mm, the difference in overall heat transfer coefficient (W/sq. m.° C.) is (5.00−4.84=0.16) based on the above formulae (3) and (4). On the other hand, when the thickness of the partition wall 58 is 0.2 mm, the difference in overall heat transfer coefficient (W/sq. m.° C.) is (5.00−4.98=0.02) based on the above formulae (5) and (6).

Therefore, in spite of the heat conductivity (120 W/m° C.) of aluminum being 400 times the heat conductivity (0.3 W/m° C.) of synthetic resin, the partition wall 58 of small thickness can achieve, even when synthetic resin is used as the material, an overall heat transfer coefficient (W/sq. m.° C.) comparable to that when aluminum is used as the material.

Furthermore, when the air flow in the air passage 57*a* of the air flowing portion 57 is not driven by natural convection but, as in the above embodiment, forcedly driven to come into contact with the partition wall 58, the heat-transfer coefficient between the outside wall surface of the partition wall 58 and the air in the air passage 57*a* is increased to about 20 (W/sq. m.° C.). In this case, the overall heat transfer coefficient (W/sq. m.° C.) when a 0.2 mm-thick synthetic resin sheet is used as the partition wall 58 can be determined from the following formula (7).

$$\text{Overall heat transfer coefficient for synthetic resin}=1/((1/10)+(0.0002/0.3)+(1/20))=6.64(\text{W/sq. m.° C.}) \quad (7)$$

As seen from comparison between the above formulae (3) and (7), the contact of air flowing through the air passage 57*a* with the partition wall 58 can increase the overall heat transfer coefficient (W/sq. m.° C.) by 37%, thus effectively cooling the toner in the toner container 50.

Since as thus far described the toner container 50 according to the above embodiment is provided with the partition wall 58 separating the toner containing portion 56 from the air flowing portion 57, a thin sheet of synthetic resin or a film of synthetic resin is used as the partition wall 58, and the air flowing through the air passage 57*a* of the air flowing portion 57 is brought into contact with the partition wall 58, the toner in the toner container 50 can be effectively cooled.

Furthermore, there is no need to apply metal having high heat conductivity, such as aluminum, as the material of the body housing 51 of the toner container 50 and synthetic resin having low heat conductivity can be applied as the material of the partition wall 58. Therefore, the present disclosure is suitable for the toner container 50 which is exchangeable and disposable.

Figure 13:
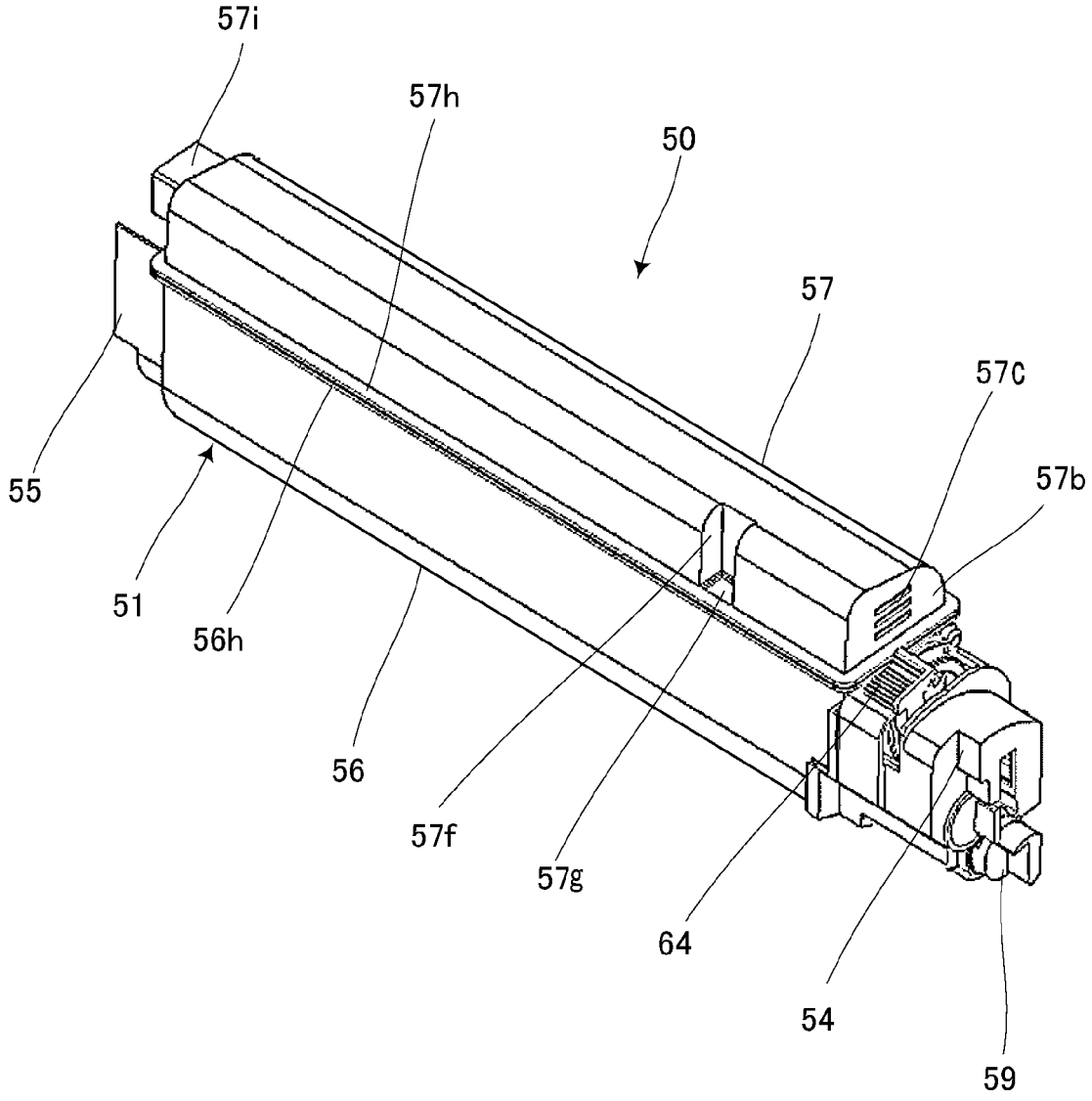
FIG. 13 is a perspective view showing a modification of the toner container.
Figure 14:
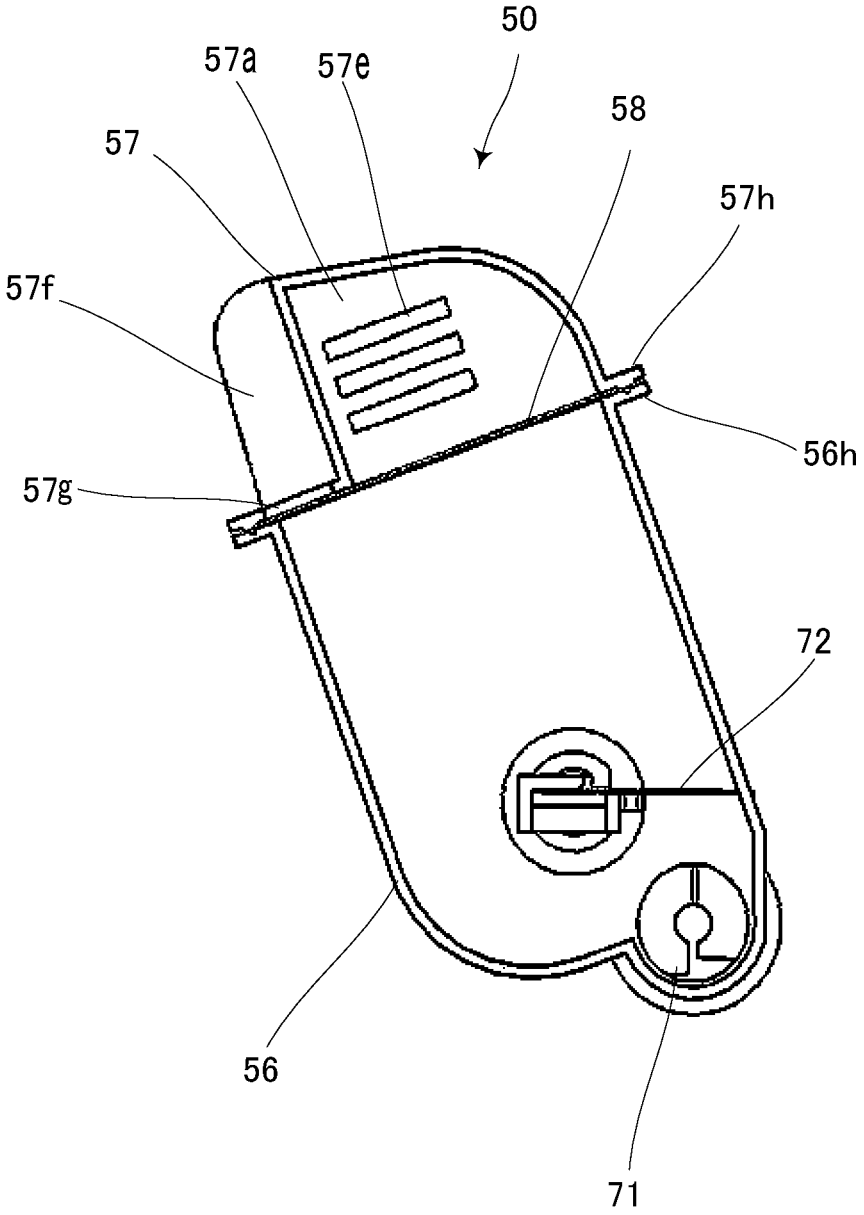
FIG. 14 is a transverse cross-sectional view showing the modification of the toner container.

FIG. 13 is a perspective view showing a modification of the toner container 50. FIG. 14 is a transverse cross-sectional view showing the modification of the toner container 50. In the toner container 50 of this modification, the peripheral wall of the air flowing portion 57 is provided with a recess 57*f* and the inside surface of the recess 57*f* is provided with a window 57*g* facing the partition wall 58.

Furthermore, transparent synthetic resin in the form of a thin sheet or a film is applied as the material of the partition wall 58.

Therefore, the interior of the toner containing portion 56 can be seen through the window 57*g* and the transparent partition wall 58 to confirm the existence/absence and the remaining amount of toner in toner containing portion 56.

Figure 15:
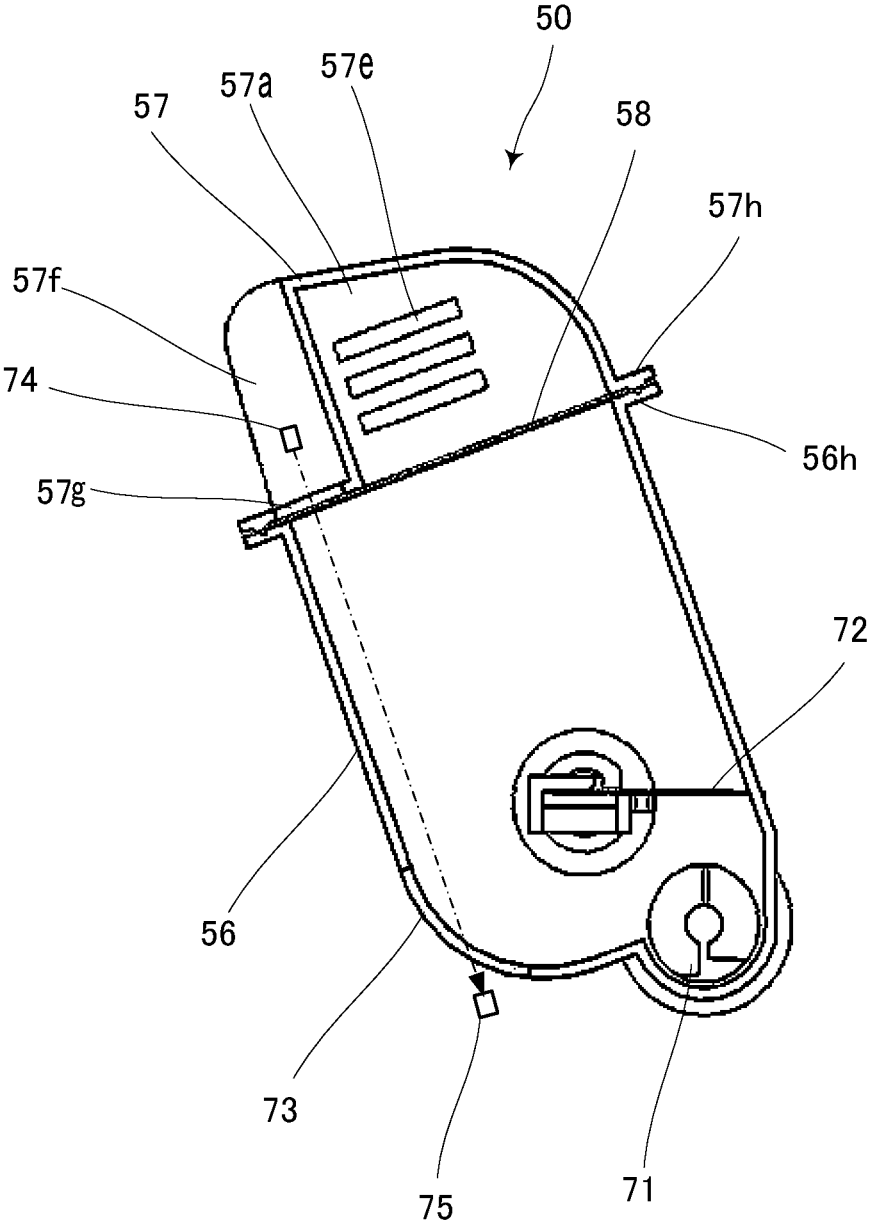
FIG. 15 is a transverse cross-sectional view showing another modification of the toner container.

FIG. 15 is a transverse cross-sectional view showing another modification of the toner container 50. In the toner container 50 of this modification, not only the air flowing portion 57 is provided with a window 57*g* but also a portion of the wall of the toner containing portion 56 is formed of a light transmissive member 73 and the light transmissive member 73 is disposed facing the window 57*g* with the toner in the toner containing portion 56 in between.

Furthermore, transparent synthetic resin in the form of a thin sheet or a film is applied as the material of the partition wall 58.

In addition, a light-emitting element 74 is disposed at a portion of the apparatus body 2 located outside the window 57*g*, a light-receiving element 75 is disposed at a portion of the apparatus body 2 located outside the light transmissive member 73, and the light-emitting element 74 and the light-receiving element 75 are opposed to each other with the window 57*g* and the light transmissive member 73 in between.

When in this structure toner exists in the toner containing portion 56, light from the light-emitting element 74 is blocked by the toner and not received by the light-receiving element 75. On the other hand, when no toner exists in the toner containing portion 56, light from the light-emitting element 74 is not blocked but received by the light-receiving element 75. Therefore, based on whether or not there is an output of the light-receiving element 75 having received light, the absence or existence of toner in the toner containing portion 56 can be determined.

In a general image forming apparatus, as the temperature of the toner container increases, the temperature of toner in the toner container also increases. However, the techniques described in BACKGROUND do not relate to the cooling of the toner container or toner in the toner container.

Furthermore, for example, even if a structure is employed in which an air passage is formed around the toner container to cool the toner container, the toner container is formed of a molded article of synthetic resin and therefore the wall of the toner container has a low heat conductivity. Hence, even if the toner container itself is cooled, the toner in the toner container cannot efficiently be cooled.

To cope with this, it may be considered to apply metal of high heat conductivity, such as aluminum, as the material of the toner container. However, if the toner container to be exchanged for new one and discarded is made of metal, this makes it difficult to discard the toner container and is uneconomic and unrealistic.

Unlike the above, in the above embodiment, the cooling efficiency of toner in the toner container can be increased as described previously.

Although in the above embodiment the toner containing portion 56, the air flowing portion 57, and the partition wall 58 are joined together, the partition wall 58 may be bonded only to the flange 56*h* of the toner containing portion 56 to encapsulate the toner in the toner containing portion 56 by the partition wall 58 and the toner containing portion 56 may be removably attached to the air flowing portion 57. In this case, a structure is employed in which the air flowing portion 57 is provided, together with the duct 81, in the interior of the apparatus body 2 of the image forming apparatus 1, the air flowing portion 57 is fixedly connected to the duct 81, and the toner containing portion 56 is attached to and removed from the air flowing portion 57.

Although the description of the above embodiment is given taking a color printer as an example of the image forming apparatus according to the present disclosure, the example is merely illustrative and the image forming apparatus may be any other image forming apparatus, including a black-and-white printer and other electronic devices, such as a multifunction peripheral, a copier, and a facsimile machine.

The structures, configurations, and processing described with reference to FIGS. 1 to 15 are merely illustrative of the present disclosure and the present disclosure is not intended to be limited to the above structures, configurations, and processing.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A toner container including a body housing, the body housing being provided with:

a toner containing portion configured to contain toner for use in image formation;

an air flowing portion adjoining the toner containing portion;

an air inlet through which air is taken into the air flowing portion; and an air outlet through which the air is discharged from the air flowing portion, wherein the toner containing portion is separated from the air flowing portion by a partition wall, a side edge portion of the partition wall is sandwiched between a flange of the toner containing portion and a flange of the air flowing portion that is provided to face the flange of the toner containing portion, the side edge portion of the partition wall is bonded to each flange of the toner containing portion and the air flowing portion, and the toner container is configured to bring the air flowing through the air flowing portion into contact with the partition wall.

2. The toner container according to claim 1, wherein the partition wall has a thickness smaller than a wall thickness of the body housing.

3. The toner container according to claim 2, wherein the partition wall is formed of a sheet-like or film-like member.

4. An image forming apparatus configured to form a toner image on a recording paper sheet, the image forming apparatus comprising:

the toner container according to claim 1;

a duct provided in an apparatus body of the image forming apparatus and connected to the air inlet for the air flowing portion of the toner container, and a fan provided in the apparatus body and configured to feed the air into the duct.

5. The image forming apparatus according to claim 4, being configured so that when the toner container is attached to the apparatus body of the image forming apparatus, the air flowing portion of the toner container is connected to the duct of the apparatus body.

6. An image forming apparatus configured to form a toner image on a recording paper sheet, the image forming apparatus comprising the toner container that includes a body housing provided with a toner containing portion configured to contain toner for use in image formation, an air flowing portion adjoining the toner containing portion, an air inlet through which air is taken into the air flowing portion, and an air outlet through which the air is discharged from the air flowing portion, the toner containing portion being separated from the air flowing portion by a partition wall and being configured to bring the air flowing through the air flowing portion into contact with the partition wall, wherein the partition wall is light-transmissive, the body housing is provided with a window facing the partition wall, at least a portion of a wall of the toner containing portion is formed of a light transmissive member facing the window with toner in the toner containing portion in between, and an apparatus body of the image forming apparatus is provided with a detecting section configured to detect existence or absence of toner in the toner containing portion through the partition wall, the window, and the light transmissive member.

7. The image forming apparatus according to claim 6, wherein the detecting section comprises a light-emitting element provided at a portion of the apparatus body located outside the window and a light-receiving element provided at a portion of the apparatus body located outside of the light transmissive member, and the light-receiving element is capable of receiving light emitted from the light-emitting element and having passed through the window, the partition wall, an interior space of the toner containing portion, and the light transmissive member.

8. An image forming apparatus including a toner container and configured to form a toner image on a recording paper sheet, wherein the toner container includes a body housing provided with a toner containing portion configured to contain toner for use in image formation, an opening provided in the toner containing portion is closed by a partition wall, thus encapsulating the toner in the toner containing portion, an apparatus body of the image forming apparatus is provided with:

an air flowing portion through which air flows;

an air inlet through which the air is taken into the air flowing portion;

an air outlet through which the air is discharged from the air flowing portion;

a duct connected to the air inlet for the air flowing portion; and a fan configured to feed the air into the duct, and the toner container is removably attachable to the apparatus body and is configured so that, upon attachment of the toner container to the apparatus body, the toner containing portion of the toner container and the air flowing portion fit together with the partition wall in between.

* * * * *